US007631529B2

(12) United States Patent
Frattini

(10) Patent No.: US 7,631,529 B2
(45) Date of Patent: Dec. 15, 2009

(54) DEVICE FOR THE SELECTIVE AND PROGRESSIVE LOCKING OF METAL CONTAINERS

(75) Inventor: Roberto Frattini, Ponteranica (IT)

(73) Assignee: Frattini S.p.A. Costruzioni Meccaniche, Seriate (IT)

( * ) Notice: Subject to any disclaimer, the term of this patent is extended or adjusted under 35 U.S.C. 154(b) by 181 days.

(21) Appl. No.: 11/794,280

(22) PCT Filed: Jun. 21, 2005

(86) PCT No.: PCT/EP2005/006673

§ 371 (c)(1),
(2), (4) Date: Jun. 26, 2007

(87) PCT Pub. No.: WO2006/069609

PCT Pub. Date: Jul. 6, 2006

(65) Prior Publication Data

US 2008/0302166 A1 Dec. 11, 2008

(30) Foreign Application Priority Data

Dec. 27, 2004 (IT) ..... MI2004A2517

(51) Int. Cl.
*B21B 15/00* (2006.01)

(52) U.S. Cl. ..... 72/125; 72/94; 72/466.9

(58) Field of Classification Search ..... 72/94, 72/117, 125, 344, 348, 351, 354.8, 466.7, 72/466.8, 466.9, 482.91, 379.4, 715
See application file for complete search history.

(56) References Cited

U.S. PATENT DOCUMENTS 4,294,097 A * 10/1981 Gombas ..... 72/94
5,469,729 A * 11/1995 Hager ..... 72/379.4
6,131,761 A 10/2000 Cheng et al.
6,237,388 B1 5/2001 Mc Clung et al.
6,490,904 B1 * 12/2002 Zauhar ..... 72/348
6,546,773 B2 * 4/2003 Hanafusa et al. ..... 72/111
2002/0000028 A1 1/2002 Jamison et al.

FOREIGN PATENT DOCUMENTS

IT 1 216 844 B 3/1990

OTHER PUBLICATIONS

International Search Report Nov. 15, 2006.

* cited by examiner

*Primary Examiner*—Edward Tolan
(74) *Attorney, Agent, or Firm*—Bucknam and Archer

(57) ABSTRACT

A device (10) for selective and progressive locking of metal containers (18) to be submitted to mechanical deformations along an extended part of side surface and provided at the bottom by a notch (20), the device having: a circular plan support (12) with an end forming a housing mouthpiece (14) of a containing body (16); a shaped and mobile ring (22) eventually cooperating with an annular seal or membrane (24) placed at the mouthpiece wherein the containers (18) are inserted starting from their respective bottom. A centering collar (26) defines the mouthpiece wherein the containers (18) are inserted and which surrounds the seal (24); a centering ring (30) whose anterior front is directed towards the containers (18) presents a complementary arrangement to the containers themselves bottom periphery and provided with a plurality of through holes; a pusher (32) tensioned by an helical spring (34), placed along the device longitudinal axis (10); means apt to realize a perfect adherence with the container (18) bottom provided with a notch (20).

11 Claims, 3 Drawing Sheets

DEVICE FOR THE SELECTIVE AND PROGRESSIVE LOCKING OF METAL CONTAINERS

CROSS REFERENCE TO RELATED APPLICATIONS

Applicant claims priority under 35 U.S.C. §119 of Italian Application No. M12004A002517 filed Dec. 27, 2004. Applicant also claims priority under 35 U.S.C. §365 of PCT/EP2005/006673 filed Jun. 21, 2005. The international application under PCT article 21(2) was published in English.

The present invention relates to a device for the selective and progressive locking of metal containers.

More particularly, the present invention relates to a device apt to lock in a selective and progressive manner metal containers to be submitted to mechanical deformation operations along extended part of their side surface. The above mentioned metal containers are the same of the known art and typically, even though non critically, those destined to realizing bottles for the aerosol market or bottles for the beverage and food market, or for technical use. Said containers, obtained from aluminum, its alloys, steel or others suitable materials, consist in raw bodies extruded or dished and drawn, which present originally a substantially cylindrical shape and which are thereafter tapered at the upper end to realize a mouthpiece or seat for a dispensing valve or to form the insert of a threaded collar. The raw bodies are fed into a known tapering machine comprising at least an intermittent motion rotating table, with a plurality of stations provided with drive organs for the themselves raw bodies temporary locking, and at least an opposed alternate traverse motion plate carrying multiple tools and chucks destined to carry out the different and sequential workings. Said workings consist in tapering the bodies top part, as well as, for instance, in cutting in size, in rimming and in possible dimensional checking of the top end of the bodies themselves. The bodies fed into the machine in a known way may be already painted externally and offset printed on the external side surface, to realize over them writings or decoration elements in various colors, such as for instance the product trademark, the content type, identification codes, instructions for final consumer and the like. During the above-mentioned operations or preliminary to them, the bodies are often subjected to local deformations which concern one or more limited areas of their side surface, at the bottom of their upper part to be tapered and near the same. Such deformations, named embossing/debossing, are realized with specific tools, that create upon prearranged areas of the bodies side surface shaped imprints, grooves and other configurations of various shape defined by notched and/or projecting sectors.

The correct localization of the bodies portion(s) onto which to realize said imprints depends from their angular position detecting specific working means: to this end, the above-mentioned bodies are suitably provided along the top edge by one or more optical reading signals, that are highlighted during a rotational phase to which they are subjected for suitable orientation.

This type of deformations in embossing/debossing shape is primarily realized to give aesthetic valences to the bodies, but it also shows partly functional characteristics as far as the final user is concerned, given the relieves shaped on the originally planar surface, of having a more comfortable and safe grip on the bodies themselves. Both to realize the tapering, and to obtain embossing/debossing localized prints, the bodies require to be gripped and stabilized during the deformation interventions carried out by the various tools. To this purpose, said bodies fed on tapering machines are inserted starting from the bottom in suitable grip members, so called pliers, that circumscribe an extended side surface part, between around 40 and 60 mm. Thanks to such gripping sizeable extension, the bodies are stabilized in an effective way, and also precisely axially aligned, and are not influenced by radial and/or axial loads to which they are subjected during these conventional deformation determining phases. On the contrary, to day a need is felt to realize aerosol, beverage, food and other purpose metal containers, in aluminum, its alloys or other suitable materials, provided with extended shaping of their side surface, non-circumscribed or not only circumscribed to a limited area upon or near the top one to be tapered. Such a need is felt primarily because said containers show intrinsically features that make them apt to various uses, for instance for food products packaging and distribution, with total hygiene guarantee, and that further allow to substantially limit the unit package weight, also for disposal and recycling, compared to other conventional packages made by for instance glass. The glass containers, however, are easily subjected to break. Further it is easily noticeable that to-day some types of glass containers have aesthetic valences superior compared to the so far known metal ones and these characteristics are some times such to orient the final consumer in a direction, to the detriment of more advantageous others.

The extended deformation of the metal containers side surface nevertheless provides considerable problems, that cannot be solved using conventional techniques through which one obtains the top surface tapering and the localized prints in embossing/debossing shape. Said extended deformation, whose purpose is to shape according to the most various configurations the side surface of the above-mentioned containers, shows in fact a substantial limitation concerning their stabilizing and maintaining constantly in a precise position. Conventional grip pliers, as above-mentioned, grip containers starting from the bottom and extend themselves along their side surface for a sizeable portion, that allows to achieve such precise fixing during working; the tapering operations concern the containers top part and the embossing/debossing ones of the adjacent area, so that the pliers can freely surround a side surface wide area.

Since, one has to operate on the side surface in a wider manner, with deformations that develop from the underlying to the tapering area up to near the containers base, the pliers gripping area reduces itself mandatorily starting from the bottom, with the consequence that the containers themselves correct stabilization and constant alignment would not be assured. Even the locking force, circumscribed to a limited area of the containers side surface starting from their bottom, may show critical aspects and, for this reason, said containers undergo preferably a mechanical deformation preliminary operation that interests specifically the bottom surface, that is suitably stiffened by molding or partial dishing carried out on the operating machine or near it.

It should be noted that a deformation intervention widely extended of the side surface submits the containers to much higher loads as compared to those that can be found in the known deformation proceedings, due to the robust efforts of the working tools that are used on an area with a greater longitudinal development. It is therefore necessary providing specific and effective initial locking means and subsequent said containers stable maintenance, remarkably embossed starting from the gripping area of their bottom, means which take into account the presence of a top lever arm compared to that which is found in known deformation proceedings, such that it leads to amplification of the maladjustment at the containers themselves opposite free end. Thanks only to such means one can avoid the inconveniences following the incorrect integration between the tools which are used on the bodies in working.

Scope of the present invention is to provide such specific means.

More particularly, the scope of the present invention is to provide a metal containers selective and progressive locking device, specifically destined to the realization of aerosol market bottles or bottles for beverage, food or other purposes, adapted to initially stabilize in an effective manner and to keep thereafter equally locked the containers themselves, even if said last are gripped along a limited area of the side surface starting from the bottom.

Further scope of the invention is to provide a locking device as described above adapted to keep said containers in constant axial alignment position during the deformation operations, notwithstanding the high loads which undergo the containers themselves by the tools that are used along an extended area of their side surface.

Further scope of the invention is to provide users with a metal containers selective and progressive locking device adapted to guarantee a high strength level in time, further such as to be easily and low priced realized.

According to the present invention, this and also other scopes are achieved by the metal containers selective and progressive locking device that are subject to mechanical deformation operations along a wide area of side surface and provided on the bottom of a notch, said device comprising:

- a circular plan support with an end forming a seat mouthpiece of a containment body;
- a shaped and movable ring eventually cooperating with a seal or annular membrane placed at the mouthpiece in which containers are inserted starting from their bottom;
- a centering collar that defines the mouthpiece in which containers are inserted and that circumscribes the seal;
- a centering ring whose anterior front towards the containers shows complementary conformation to the containers themselves bottom periphery and is provided with a plurality of through holes;
- a pusher tensioned by a helical spring, placed along the device longitudinal axis;
- means adapted to realize perfect adherence with the bottom of container provided with notch.

The construction and functional characteristics of the locking device of the present invention may be better understood from the following description, that refers to the accompanying drawings tables which represent a preferred and non limitative embodiment and in which.

Figure 1:
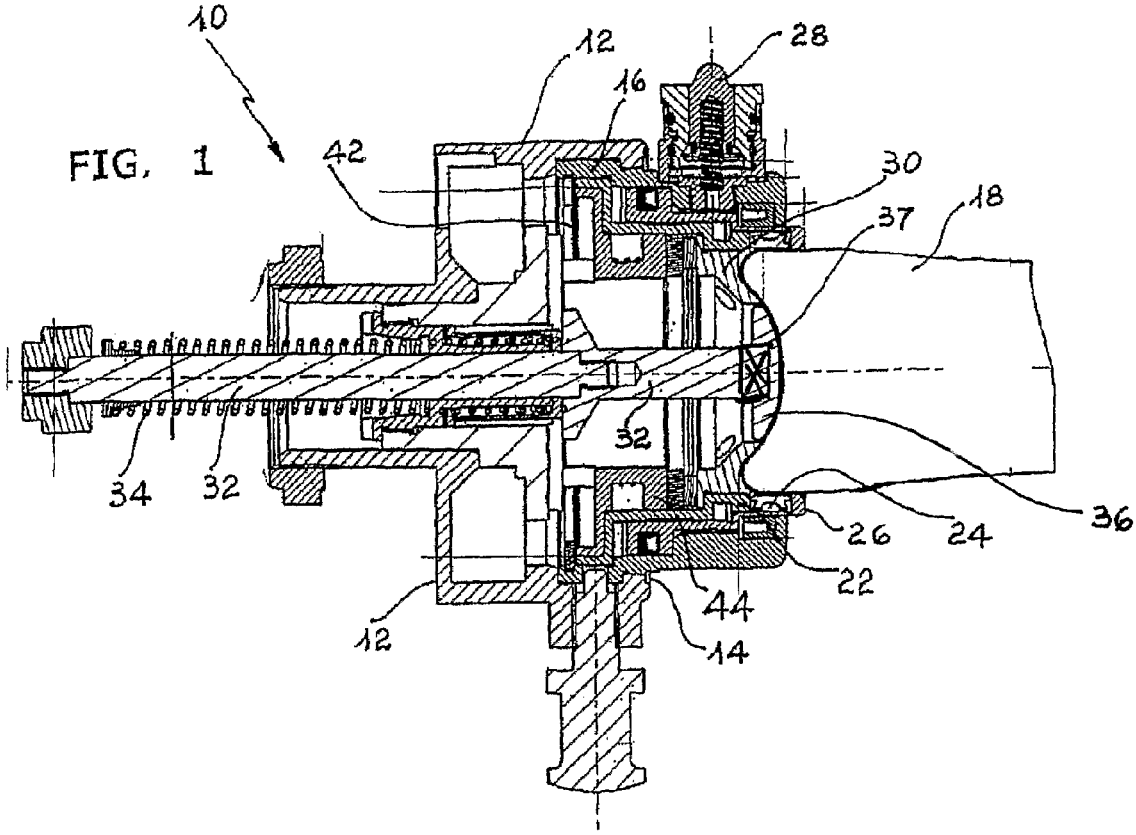
FIG. 1 shows schematically a longitudinal section of the locking device of the present invention

Referring to the above-mentioned figures, the present invention metal containers selective and progressive locking device, indicated in the ensemble as 10 at FIG. 1, comprises a circular plan support 12 defining at one end a seat mouthpiece 14 for a containment body 16, projecting from the support itself on the anterior front towards the container to submit to extensive forming interventions in the side surface.

Figure 2:
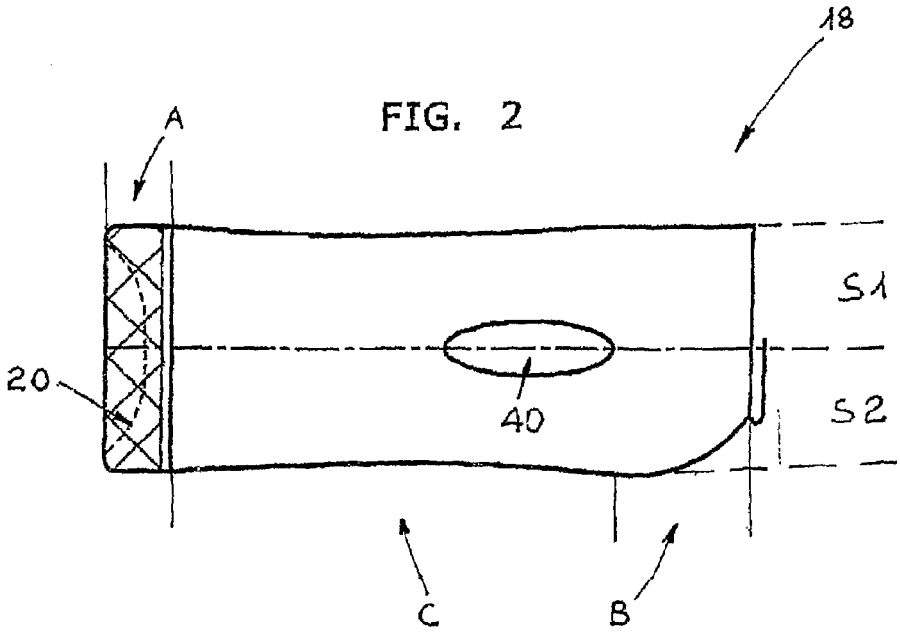
FIG. 2 shows schematically, in side view, an example of metal container provided with extended shaping of the side surface.

Said container is indicated at 18 in FIG. 1 and is also represented in a side view at FIG. 2; in this last one, container 18 is shown by exemplification according to two configurations corresponding to different working phases, that is top half-part "S1" provided with said large forming and with bottom half-part "S2" upon which is also carried out the following tapering operation in the area next to the mouthpiece. The container 18 forming, as shown from FIG. 2 extends for a considerable part of the side surface, preferably involving the full area comprised between the bottom, from which is spaced for a limited stroke, indicated as "A" and exemplary comprised between 10 and 30 mm, and the opposite top portion, indicated as "B", destined to the following deformation operation. The container 18 side surface part interested to forming is therefore quite extended, indicated as "C", and limits therefore the gripping area starting from container 18 bottom.

Last, as above-mentioned, is provided earlier on said bottom with a mechanical deformation, obtained by known devices, that creates a recess or partial dishing 20 conformed, for instance, at spherical dome, adapted from one side to stiffen the container itself along the bottom and, on the other, to create a precise coupling seat with stabilization means as will be explained next.

To the containment body 16, seated in the support 12 mouthpiece, is coupled a shaped ring 22 preferably cooperating with a seal or annular membrane 24, placed at the mouthpiece on which the containers 18 are placed starting from their bottom and held there by a centering collar 26. The shaped ring 22 may be realized in metal or other suitable material and comprise two or more complementary sectors, radially movable with any means suitable for locking circumferentially containers 18. Correspondingly or next to said mouthpiece housing containers 18 a radial conduit 28 is realized, through which is blown pressurized fluid, typically air. The fluid blown in by the conduit 28 determines the backward movement of the shaped ring 22, serving as a piston or pusher with respect to seal 24, that expands radially towards the inside embracing and restricting the container 18. It may be noted, from FIG. 1, that the container 18 area upon which said seal acts, with or in combination with collar 26 front exposed end, is very limited dimensionally, given that it is needed to let free the whole container 18 part that develops from such proximity towards the opposed end to allow extensive deformation in the container itself along its side surface area "C". A so limited container 18 gripping and stabilizing point does not result therefore sufficient to its stable locking, nor to its axial alignment during operations, so that, according to the present invention, it is necessary to provide other holding means for this. To the purpose, in an advantageous way, device 10 comprises a centering ring 30, coaxial to the shaped ring 22, whose anterior front, towards the mouthpiece in which containers 18 are placed, is shaped in a corresponding way as the containers themselves bottom periphery, specifically in their annular zone external to such mouthpiece or partial dishing 20. Further, device 10 comprises a pusher 32, tensioned for instance by one or more helical springs 34, that develops along the device 10 longitudinal axis and carries at its front end a dish 36 having a precisely complimentary configuration to notch 20 realized on container 18 bottom. The centering ring 30 and dish 36 are provided with a plurality of through holes, through which a forced air suction is carried out, for instance starting from one or more conduits 31 realized on support 12.

The air void determines container 18 stabilization or pre-stabilization starting from its bottom surface, to which dish 36 is coupled precisely, and also centering ring 30 that houses the periphery of container 18 above-mentioned bottom, realizing a perfect adherence between complimentary parts. In the basis of the combined air void and seal or annular membrane 24 effect, that is deformed by the axial sliding of the shaped ring 22 and consequently locks container 18 perimeterly in the next to bottom area, said container results stabilized in an optimal way in device 10, even if it is gripped along a minor area of its side surface.

This way also the precise axial alignment of container 18 is guaranteed during the various operational phases that lead to the shaping of "C" area of its side surface.

During or after such operations, may be carried out on containers 18 even one or more embossing/debossing interventions which lead to the creation of as many projecting or recessed prints along their shaped side surface, for instance in the area next to "B" portion that is tapered next. As an example, a similar print is sketched with 40 at FIG. 2.

As will be detailed, the embossing/debossing realization supposes angular containers 18 orientation and therefore it is necessary they have the possibility to rotate around themselves once inserted in device 10.

Figure 3:
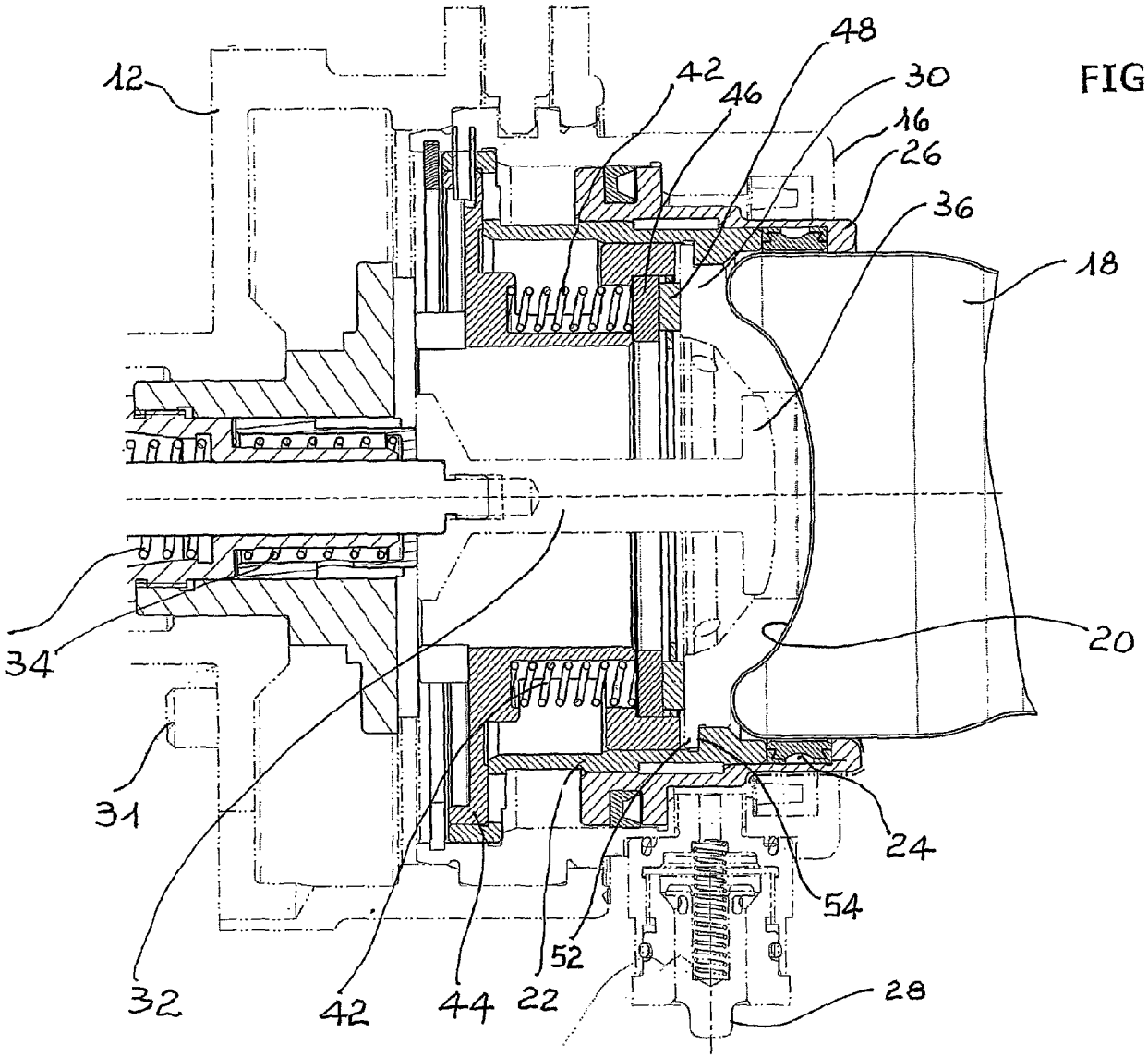
FIG. 3 shows a partial enlargement of FIG. 1, particularly of the locking device of the present invention front part.
Figure 4:
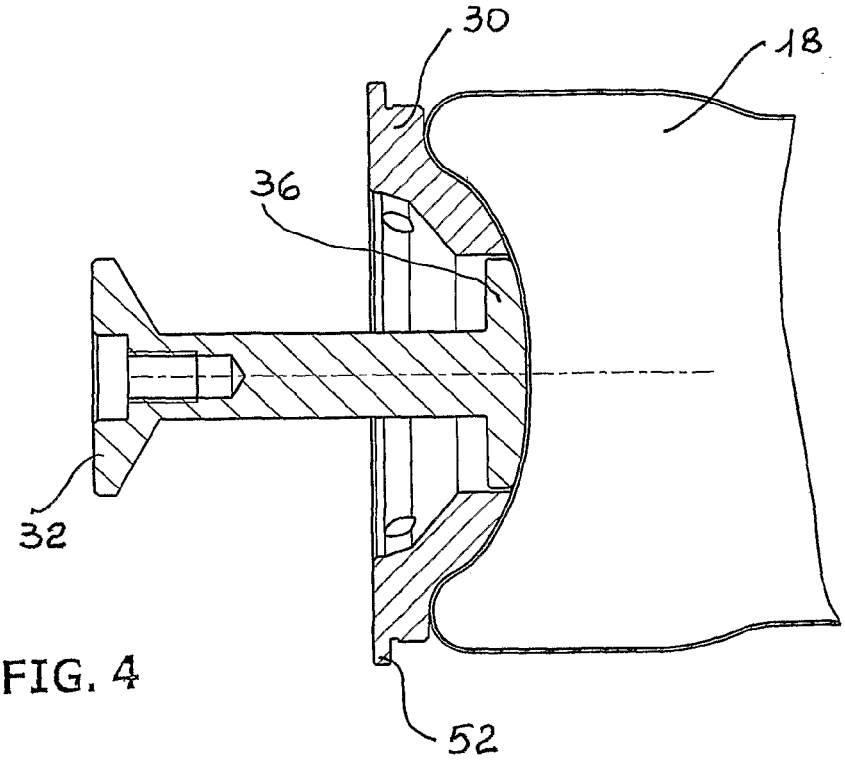
FIGS. 4 and 5 show further enlarged details of FIG. 3.
Figure 5:
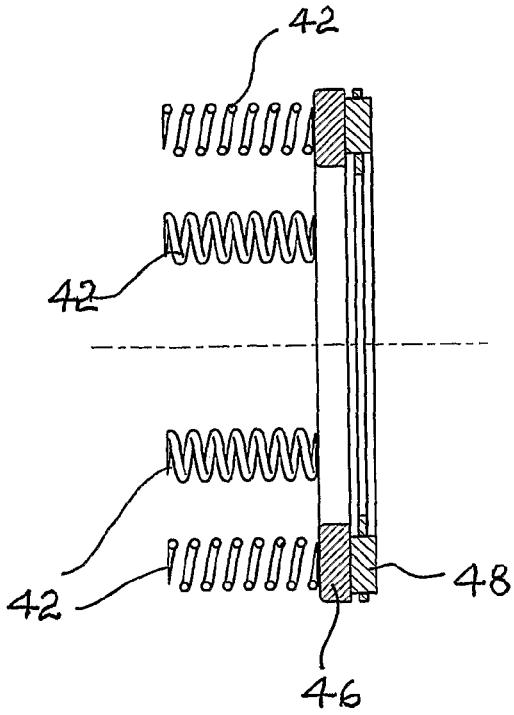

To the purpose, this last comprises elastic means 42, for instance in shape of cup or helical springs, placed between holding body 16 and support 12 or, preferably, between a sleeve 44 coaxial with shaped ring 22 and centering ring 30, as shown at FIG. 3. Said elastic means 42 match, at the front end towards the centering ring 30, a bearing comprising a rear fixed part 46 and a rotating front part 48, this latter in contact with centering ring 30 itself. Bearing fixed part 46 and rotating part 48, together with elastic means 42, is sketched in detail at FIG. 5. The above-mentioned bearing is peripherically delimited by an annular member 50, coaxial to shaped ring 22. Perimetrally to centering ring 30 a solid annular collar 52 is realized, that matches a shoulder 54 realized on the shaped ring 22, along its front part next to the mouthpiece on which container 18 is inserted. In device 10 non-operational conditions, that is in the absence of a container 18 placed in said mouthpiece and axially pushed therein by known feeding means, springs 42 are extended and keep collar 52 of centering ring 30 in beat against shaped ring 22 shoulder 54, avoiding its rotation. At the time the container (18) is inserted starting from the bottom in device (10) mouthpiece, perfect adherence takes place between said bottom on the one side and the dish 36 with the centering ring (30) adjacent shaped part. Such perfect adherence is kept by activation of the air vacuum starting from conduit/s 31. The conventional container (18) feeding means in device (10) push the container itself against plate 36 and centering ring 30; the latter, on its part, pushes on the bearing rotating part 48 and upper fixed part 46. Elastic means 42, accordingly, compress and allow centering ring 30 backward movement, for a limited stroke; this latter annular collar 52, therefore, disengages from shaped ring 22 shoulder 54 and said centering ring 30 is free to rotate. Together with centering ring 30 rotate container 18, dish 36 and the bearing front part. Between dish 36 and pusher 32 is advantageously interposed a further roll bearing 37 or the like, adapted to avoid that the dish rotation involves also said support 32. Obtained container 18 suitable angular orientation, following its rotation dictated by for themselves known means, the push effect on the container itself ends; elastic means 42 extend and centering ring 30 annular collar 52 return in contact with shoulder 54. At this time container 18 may undergo operational deformation phases along its side surface extended area "C"; to the purpose, said container is locked also at seal or expandable membrane 24, that is driven to expand radially to circumferentially block container 18 itself in its limited extension area "A", comprised between the bottom provided with the notch 210 and above-mentioned area "C". The seal 24 expansion is determined by the shaped ring 22 axial sliding, which moves near and presses the seal itself under inlet of pressurized air in device 10 effect starting from conduit 28. The container 18 under these conditions is blocked, first starting from bottom whereupon acts the air vacuum that leads to a perfect adherence and a perfect coupling of bottom itself with dish 36 with centering ring 30; second, container 18 is locked also circumferentially, along near to bottom area "A", by seal 24 radially expanded due to the compression exerted on shaped ring 22. Under such safe and constant locking condition, container 18 is also perfectly axially aligned and is able to support the deformation tools high loads even though it is considerably projected from the grip zone. Of course, if containers do not require being through rotation angularly oriented, because it is unnecessary to create thereupon embossing/debossing shaped prints, centering ring 30 backward movement does not take place; device 10, in such case, may be without at least elastic means 42 and eventually of bearing front 48 and/or back 46 part. Even though the solution to lock by air vacuum containers 18 starting from the bottom, other equivalent means may be used alternatively to this purpose; such locking may take place, for instance, through magnets if containers 18 are in ferromagnetic material or through suction cups or the like. As may be noted from the above, the advantages which the invention achieves are evident.

The locking device of the present invention allows to lock, keep stabilized and axially aligned containers 18 during working phases that deform side surface extended part "C" even in the presence of an area next to bottom limited grip point, given the effects of the air vacuum, that exerts itself substantially on the whole bottom surface, and of seal 24, thus realizing the perfect adherence between the bottom itself on the one side and dish 36 and centering 30 on the other.

Further advantageous is the possibility to orient if on occurrence containers 18 to create upon them embossing/debossing shaped prints, thanks to centering ring 30 temporary backward displacement while it is preferably being activated the air vacuum that assures sufficient treatment of containers themselves.

Even though the invention has been described above referring particularly to one its preferred and not limitative embodiment, various modifications and variations will be apparent to an expert in the art in view of the above-described description. Thus, the present invention, tends to encompass all modifications and variations within the protective spirit and scope of the appended claims.

The invention claimed is:

1. A selective and progressive locking device (10) for metal containers (18) to undergo deformation mechanical operations along a side surface extended part and provided on the bottom with a notch (20), said device comprising:

a circular plan support (12) with an end forming a mouthpiece (14) to seat a containment body (16);

a shaped and mobile ring (22) eventually cooperating with a seal or annular membrane (24) placed at the mouthpiece in which containers (18) are inserted starting from respective bottom;

a centering collar (26) that defines the mouthpiece in which containers (18) are inserted and that circumscribes seal (24);

a centering ring (30) whose anterior front towards containers (18) shows complimentary conformation to the bottom periphery of containers themselves;

a pusher tensioned by a helical spring (34), disposed along a longitudinal axis of said device (10);

means adapted to realize perfect adherence with the container (18) bottom provided with a notch (20);

wherein elastic means (42) are disposed between said containment body (16) and support (12), and said centering ring (30) is provided with a plurality of through holes cooperating with a vacuum to stabilize said containers (18).

2. The device according to claim 1, wherein said means adapted to realize perfect adherence with bottom provided with a notch (20) of said container (18) comprises a dish (36) placed at the front end of said pusher (32) and said centering ring (30) cooperating with said pusher.

3. The device according to claim 1, wherein said support (12) comprises a pressurized fluid inlet radial conduit (28) for ring (22) axial movement destined to radially press and expand said seal (24).

4. The device according to claim 2, wherein said dish (36) shows a complimentary configuration to the bottom notch (20) of said containers (18) and is provided with a plurality of through holes.

5. The device according to claim 4, wherein said support (12) comprises one or more conduits (31) through which an air vacuum is created for containers (18) stabilization through centering ring (30) and dish (36) through holes.

6. The device according claim 1, wherein the elastic means (42) are realized from helical or cup springs.

7. The device according to claim 6, wherein the elastic means (42) are realized from helical springs placed between a sleeve (44) that is coaxial to said shaped ring (22) and centering ring (30).

8. The device according to claim 6, wherein said elastic means (42) realized by helical springs match, at anterior end towards centering ring (30), a bearing comprising a rear fixed part (46) and a rotating front part (48) placed in contact with centering ring (30) itself.

9. The device according to claim 8, wherein the bearing comprising fixed rear part (46) and a rotating front part (48) is peripherally contoured by an annular member (50) coaxial to said shaped ring (22).

10. The device according to claim 1, wherein the centering ring (30) is peripherally provided with a solid annular collar (52) matching a shoulder (54) realized in said shaped ring (22).

11. The device according to claim 1, wherein the gripping area of said metal containers (18) extends for 10-30 mm starting from the container bottom.

* * * * *